US005903246A

United States Patent [19]

Dingwall

[11] Patent Number: 5,903,246

[45] Date of Patent: May 11, 1999

[54] CIRCUIT AND METHOD FOR DRIVING AN ORGANIC LIGHT EMITTING DIODE (O-LED) DISPLAY

[75] Inventor: Andrew Gordon Francis Dingwall, Princeton, N.J.

[73] Assignee: Sarnoff Corporation, Princeton, N.J.

[21] Appl. No.: 08/832,890

[22] Filed: Apr. 4, 1997

[51] Int. Cl.[6] ..... G09G 3/32

[52] U.S. Cl. ..... 345/82; 345/46

[58] Field of Search ..... 345/44, 46, 82, 345/83, 205, 206

[56] References Cited

U.S. PATENT DOCUMENTS

| | | | |
|---|---|---|---|
| 4,417,240 | 11/1983 | Ahmed | 340/782 |
| 4,887,074 | 12/1989 | Simon et al. | 340/782 |
| 4,924,217 | 5/1990 | Uwai | 340/782 |
| 4,967,192 | 10/1990 | Hirane et al. | 340/811 |
| 5,061,861 | 10/1991 | Sameshima et al. | 307/270 |
| 5,142,343 | 8/1992 | Hosokawa et al. | 357/17 |
| 5,184,114 | 2/1993 | Brown | 340/701 |
| 5,309,151 | 5/1994 | Aoki | 345/211 |
| 5,408,109 | 4/1995 | Heeger et al. | 257/40 |
| 5,451,977 | 9/1995 | Kusuda et al. | 345/44 |
| 5,491,491 | 2/1996 | Lebby et al. | 345/7 |
| 5,532,718 | 7/1996 | Ishimaru | 345/211 |
| 5,612,549 | 3/1997 | Nelson et al. | 257/88 |
| 5,719,589 | 2/1998 | Norman et al. | 345/82 |
| 5,719,648 | 2/1998 | Yoshii et al. | 349/42 |
| 5,723,950 | 3/1998 | Wei et al. | 345/78 |

*Primary Examiner*—Amare Mengistu
*Assistant Examiner*—Ricardo Osorio
*Attorney, Agent, or Firm*—William J. Burke

[57] ABSTRACT

Disclosed is a technique for driving a column of pixels implemented using O-LEDs. The technique includes separate, digitally adjustable current sources on each column conductor of the array. For each column, the digitally-programmed current flow terminates with a reference O-LED and a series NMOS transistor forming the input leg of a novel, distributed current mirror. The current is "mirrored" to the output leg of the distributed current mirror which can service any one of a plurality of active O-LEDs in the column based on a row select signal. In this way, a transistor on the output leg of the current mirror couples its respective O-LED to a source of operational power. The mirrored charge on the gate of the output leg transistor causes it to apply the same current to the active O-LED as was applied to the reference O-LED through the input leg transistor. Additionally, the voltage drop across the NMOS transistor and the reference O-LED is used to charge a capacitor associated with the selected O-LED. The charging of the capacitor, as a result of the digitally-programmed current supplied through the NMOS transistor to the reference O-LED, allows for continuous driving of the active O-LED during a cycle through. Thus, a reference O-LED in conjunction with an NMOS transistor, services all of a plurality of sequentially-loaded rows within each column.

15 Claims, 2 Drawing Sheets

CIRCUIT AND METHOD FOR DRIVING AN ORGANIC LIGHT EMITTING DIODE (O-LED) DISPLAY

FIELD OF THE INVENTION

The present invention generally relates to column drivers for pixel arrays and, more particularly, the present invention relates to a circuit and method for driving a column of a pixel array configured with organic light emitting diode (O-LED) pixels.

BACKGROUND OF THE INVENTION

Display technology pervades all aspects of present day life, from televisions to automobile dashboards to lap top computers to wrist watches. At the present time, cathode-ray tubes (CRTs) dominate display applications in the 10–40 inch (diagonal) display size. CRTs, however, have many disadvantages including weight, lack of ruggedness, cost, and the need for very high driving voltages.

Recently, passive-matrix liquid-crystal displays (LCDs) and active-matrix liquid crystal displays (AMLCDs) have become dominant in midrange display applications because of their use in lap top computers. For smaller pixel sizes and also for large projection displays, the AMLCD is becoming increasingly important. A major drawback of AMLCDs, however, is the requirement of a back light that substantially increases the size and weight of the display. It also leads to reduced efficiency since the back illumination is applied continuously even for pixels in the off state.

Another approach is the deformable-mirror display (DMD) based on single-crystal silicon technology. In this approach, a micro-machined mirror structure is oriented in either a reflective or dispersive mode depending whether a logic "1" or logic "0" has been written into a corresponding cell. DMD displays must operate in the reflective mode, thus, the optics are more complicated and not as compact or efficient as transmissive or emissive displays. Additionally, like AMLCDs, DMDs require an external light source, thus, they are larger and less efficient than the self-emissive displays.

Field-emission displays (FEDs) may also be considered for many applications. However, FEDs have many of the disadvantages associated with CRTs, particularly the need for cathode voltages over 100 volts, and the corresponding requirements that the thin film transistors (TFTs) have low leakage current. FEDs have relatively lower overall luminous efficiencies due to the reduced efficiency of "lower-voltage" phosphors and the use of high voltage control voltages.

Finally, another type of display, an active matrix light emitting diode (AMEL) display, emits light by passing a current through a light emitting material. In the case of an EL, an alternating current (AC) is passed through an inorganic light emitting material (e.g., PN junction is formed from inorganic semiconductor material such as silicon or gallium arsenide. The inorganic light emitting material is arranged such that dielectrics are present on either side of the emitting material. Due to the existence of the dielectrics, relatively high voltages are required to generate sufficient light from the emitting material. The relatively high voltages are typically between 100–200 volts.

The use of an AC voltage and other factors limit the efficiency of the overall display.

Also, with respect to the stability of inorganic LED displays, the brightness of the light emitting material saturates with applied voltage after a rapid transition from off to on. If the display is operated in a "fully on" and "fully off" mode, any shift in transition voltage with time has only a minimal effect on brightness.

With these disadvantages of the various display technologies in mind, a better type of display would be desirable which requires less voltage, is more efficient and is generally more advantageous for all types of display applications.

SUMMARY OF THE INVENTION

The present invention involves a technique for driving a plurality of active organic light emitting diodes (O-LEDs) arranged in a column each at a desired brightness. The invention includes a distributed current mirror having an input leg for establishing a reference current to drive an active O-LED; a plurality of selecting means, responsive to a row select signal, for respectively selecting an active O-LED on an output leg of the distributed current mirror; an output leg of a current mirror, responsive to the selecting means, for supplying a mirror of the established reference current to the selected O-LED; and, a plurality of charging means, responsive to the selecting means, for respectively storing a voltage differential which is used to establish the mirror of the reference current in the selected output leg of the current mirror in order to continuously drive the selected O-LED.

BRIEF DESCRIPTION OF THE DRAWINGS

The invention is best understood from the following detailed description when read in connection with the accompanying drawing, in which.

DETAILED DESCRIPTION OF THE INVENTION

Overview

Figure 1:
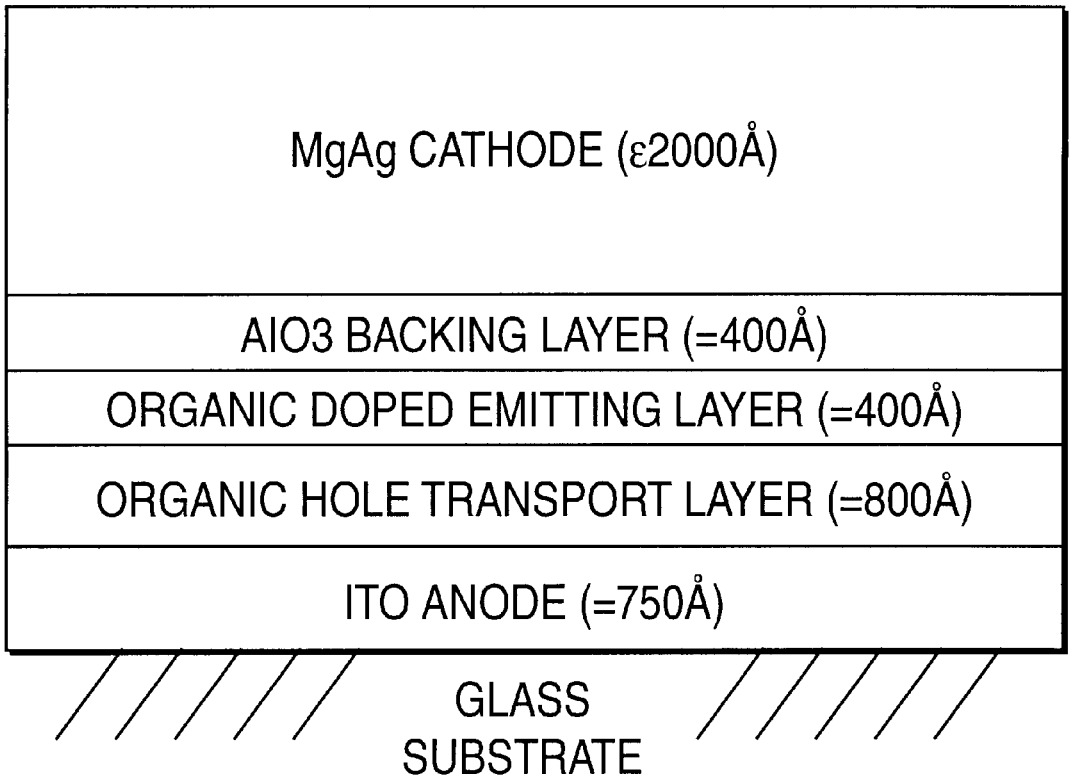
FIG. 1 shows an exemplary illustration of a display fabrication, including organic light emitting diode (O-LED) material, suitable for use with the present invention.

A better alternative to the display technologies described in the BACKGROUND section of this application is an active matrix organic light emitting diode (AMOLED) display. In the case of AMOLED displays, an organic rather than inorganic material is used to form the LED. Examples of using organic material to form an LED are found in U.S. Pat. No. 5,142,343 and U.S. Pat. No. 5,408,109, both of which are hereby incorporated by reference. An exemplary embodiment of the O-LED used with the present invention is described below in detail with reference to FIG. 1.

Briefly, for an O-LED, a direct current (DC) is passed through the organic diode material to generate light. The breakdown is in the reverse direction. Through experimentation, it has been found that the voltage needed for the light emitting material to emit a given level of light increases with time, hence, the transition voltage from "off" to "on" increases with time without substantial saturation. It has also been found, however, that a given light level (brightness) is relatively stable with the current that is passed through the organic diode material. Additionally, since threshold voltage is sensitive to processing, fixed, small drive voltage levels may be rendered ineffective due to process variation in the O-LED manufacturing process.

The present invention involves a technique for driving a column of pixels implemented using O-LEDs. The technique of the present invention includes separate, digitally adjustable current sources on each column line of the array. For each column, the digitally-programmed current flow terminates with a reference O-LED and a series transistor forming the input leg of a novel, distributed current mirror.

The current is "mirrored," responsive to a row select signal, to a selected O-LED on the output leg of the distributed current mirror. A transistor on the output leg of the current mirror couples its respective O-LED to a source of operational power. The mirrored charge on the gate of the output leg transistor causes it to apply the same current to the active O-LED as was applied to the reference O-LED through the input leg transistor. The distributed current mirror is an important aspect of the present invention because it minimizes the number of current sources required to drive the display which, in turn, conserves, for example, space, power and cost.

Additionally, the voltage drop across the NMOS transistor and the reference O-LED is used to charge a capacitor, for the particular row selected. When the output leg of the current mirror is deselected, the current flow is maintained via the charge stored on the capacitor and the O-LED continues to emit light. The continuous driving of the active O-LED is important because significant flicker may occur unless each O-LED pixel is driven continuously with small currents. The continuous driving also increases the brightness of the display for a given drive current. The continuous, variable pixel currents are in the range of a microamperes or less.

Thus, in the exemplary embodiment of the present invention, a reference O-LED in conjunction with an NMOS transistor, services all of a plurality of sequentially-loaded rows within each column.

It is noted that pixel brightness is approximately proportional to the product of current and "on" time over a range of 10,000. Because pixel life and threshold degrades at high current densities, it is important not to overdrive the pixels, therefore, it is desirable to drive the pixels for longer intervals at lower current densities.

Exemplary Embodiment of the Invention

Before describing the pixel driving technique in detail, the structure of an O-LED is described. An important feature of the present invention is the fact that the O-LED materials achieve relatively high values of brightness at relatively low drive voltages. The O-LEDs employed in the present invention begin to emit light around or above 10 volts. Additionally, the current drive nature of the O-LED material active-matrix drive transistors having relatively poor leakage current requirements to be used. Thus, the present invention may use low-cost glass substrates.

Generally, the process for the formation of an overall display using O-LEDs includes several steps:

1) forming polysilicon active-matrix circuitry;
2) integrating the O-LED material with the active-matrix array;
3) integrating color shutters (for color displays); and
4) assembling and testing the completed panel.

As mentioned above, the first step in the exemplary fabrication process is the formation of the active-matrix circuitry. For the present invention, a polysilicon thin-film transistor (TFT) technique is employed. The desired circuitry to be formed is described below in detail with reference to FIG. 2.

The second step in the process involves deposition of the LED materials on the active-matrix array.

FIG. 1 shows an exemplary illustration of a O-LED fabrication suitable for use with the present invention. Referring to FIG. 1, first, a transparent conducting electrode, such as Indium Tin Oxide (ITO), is deposited and patterned. This is followed by the deposition of a hole transporting layer, a doped emitting layer and an $AlO_3$ backing layer. The array is completed with the deposition of an MgAg top electrode resulting in the O-LED "stack" shown in FIG. 1.

For the present invention, Table I presents the exemplary thicknesses for each layer of the O-LED stack:

TABLE I

| LAYER | THICKNESS |
|---|---|
| transparent conducting electrode | app. 750 Angstroms |
| transporting layer | app. 800 Angstroms |
| doped emitting layer | app. 400 Angstroms |
| backing layer | app. 400 Angstroms |
| top electrode | app. 2000 Angstroms |

Continuing with the process, the third step in the exemplary process is the integration of color shutters on the opposite side of the glass substrate. The color shutter technique is exemplary. A patterned array of red, green and blue O-LEDs could be used for power efficiency purposes.

Finally, the display is packaged and tested. Although not shown, the packaging includes a mechanical support for the display, means for making a reliable connection to external electronics and overcoat passivation.

O-LEDs have demonstrated extraordinary efficiencies. The luminous efficiency is as high as 151/w. Brightness values of 2000 $cd/m^2$ have been achieved at operating voltages below 10 volts and a current density of $20ma/cm^2$. Orders of magnitude higher brightness have been measured at higher current densities.

Figure 2:
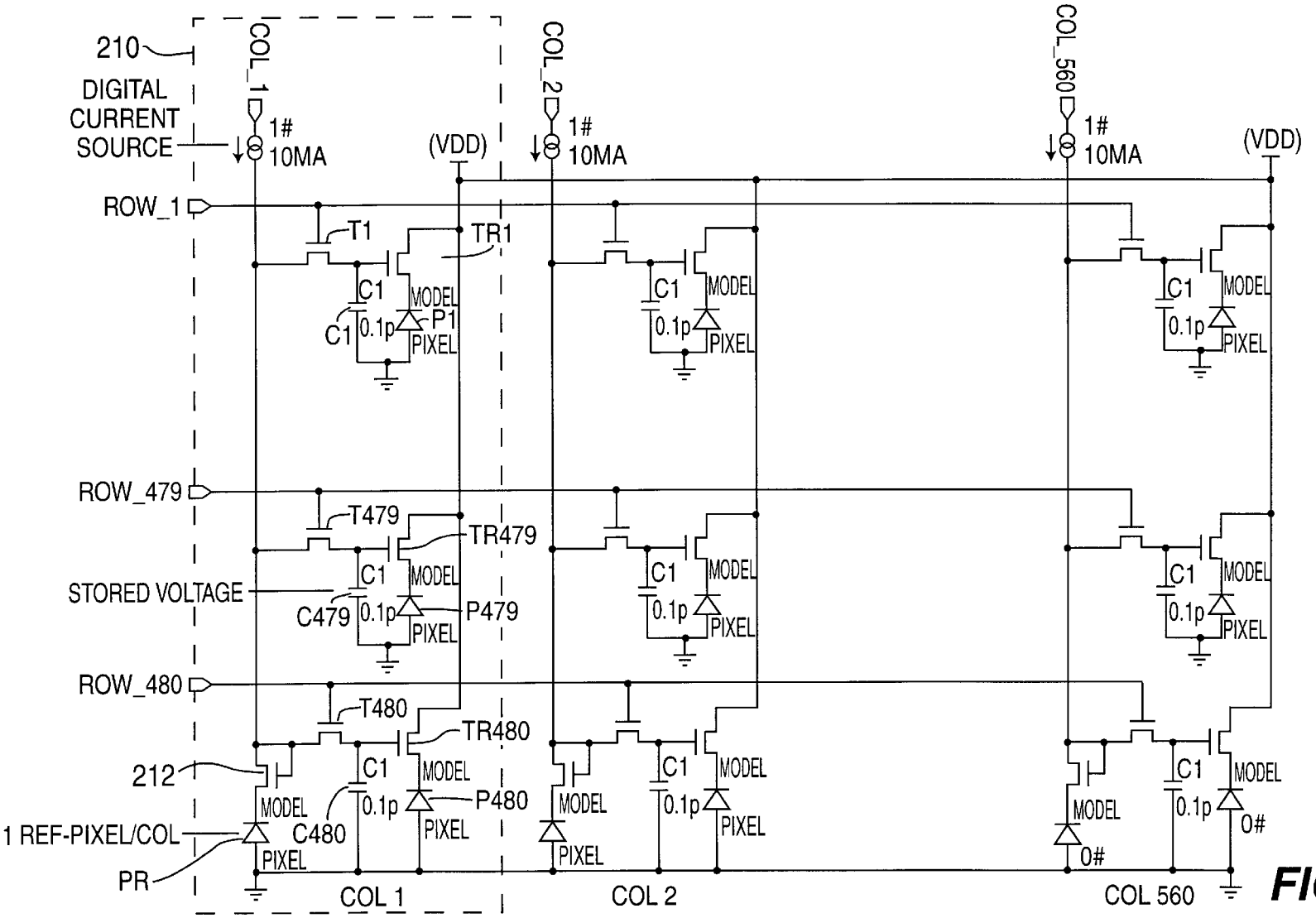
FIG. 2 shows a circuit diagram of a O-LED pixel array employing an exemplary embodiment of the present invention.

FIG. 2 shows a circuit diagram of a O-LED pixel array employing an exemplary embodiment of the present invention. As shown in FIG. 2, the exemplary O-LED pixel array includes 480 rows and 560 columns. The present invention is not limited by the number of rows and columns, however, it is contemplated, as will be appreciated by those skilled in the art, the voltage and current requirements may vary with the number of rows and columns.

Because the circuit for each column is identical, the following description focuses on column 1 which is indicated by the dotted-line box 210. The operation of the remaining columns is the same as that for column 1.

The exemplary embodiment of column 1, as mentioned above, includes 480 rows of O-LED pixels labeled $P_1$ through $P_{480}$ (only pixels $P_1$, $P_{479}$ and $P_{480}$ are shown). As seen in FIG. 2, each of the circuits employed for selecting and driving the individual pixels, $P_1$, $P_{479}$ and $P_{480}$ are the same. All of the pixels in column 1 are arranged in parallel with respect to one another. The parallel arrangement is characterized by each of the pixels in a column being coupled between a column select conductor (e.g., COL1) and a conductor which supplies operational power (e.g., VDD). Pixel $P_{480}$, the last pixel in column 1, however, is also coupled to a reference pixel, $P_R$ (sometimes referred to as a "dummy pixel"). It is noted that, in the exemplary embodiment, the operational power source voltage applied to each NMOS transistor is approximately 20 volts due to the low microampere current levels and an approximately 10 volt O-LED pixel threshold.

The reference pixel, $P_R$, is used to establish a proper current, by way of distributed current mirror circuitry, for driving any one of the active O-LED pixels in column 1. In particular, the column select conductor, COL1, which is coupled to a digitally-programmable current source (not shown), supplies current to transistor 212 and reference pixel $P_R$. The appropriate driving current, established by the digital current source, causes a voltage differential between the gate electrode and the source electrode of transistor 212 which is appropriate to provide the programmed current value to the reference O-LED, $P_R$. The combined voltage differential is applied, when a particular row is selected by way of its respective switching transistor (e.g., transistor $T_{480}$ for row 480), to the gate electrode of transistor $TR_{480}$ and the respective charging capacitor (e.g., $C_{480}$). The combined voltage differential, when row 480 is selected, being applied to the gate electrode of $TR_{480}$, thereby "mirrors" the current driving reference pixel $P_R$ for the active light-emitting pixel $P_{480}$ by way of the operational power source VDD. It also charges capacitor $C_{480}$ to produce a gate to source voltage differential ($V_{GS}$) on transistor $TR_{480}$ which is substantially the same as $V_{GS}$ on transistor 212. Practically speaking, however, $V_{GS}$ on transistor 480 will be slightly higher than the $V_{GS}$ on transistor 212 (e.g., 11 or 12 volts rather than 10 volts) since the drain and gate electrodes of transistor 212 are tied together. In the exemplary embodiment of the present invention, capacitor $C_{480}$ is approximately 0.1 pf.

The voltage stored on capacitor $C_{480}$ is designed to continuously drive transistor $TR_{480}$ such that pixel $P_{480}$ is provided with substantially the same current, supplied from VDD, as that driving the reference pixel $P_R$. In this way, because capacitor $C_{480}$ is charged to the established voltage, when other rows are sequentially selected (i.e., cycled through) in order to drive the entire pixel array, the charge on capacitor $C_{480}$ keeps $TR_{480}$ on so to substantially maintain the desired brightness on pixel $P_{480}$ until capacitor $C_{480}$ is refreshed. In the exemplary embodiment of the present invention, even if the charge begins to dissipate and the brightness begins to fade, the fading is so insignificant that it is beyond human detection when viewed in the context of all of the other illuminated rows. Thus, the O-LEDs are driven during the entire frame time—not just the line time—thereby increasing brightness by approximately 500 times compared to conventional line-at-a-time addressing. In fact, because the O-LEDs are continuously driven during the entire frame time, the frame rate can be lowered to conserve power. For example, the frame rate can be lowered to 5 frames/sec without noticeable flicker effects.

In the exemplary embodiment of the present invention, it is desirable that reasonably close matching exist between a particular reference pixel and the active pixels for the column serviced by that reference pixel. As is appreciated by those skilled in the art of optical panel design, this can usually be achieved by ensuring that the pixels are essentially the same size and by keeping cross-panel process variations to a minimum. Additionally, the reference O-LEDs, although designed to emit light for matching purposes, can be obscured by a thin second level metal or other opaque material. Although, since the reference O-LEDs are coupled to the active O-LEDs in the last row, the additional light may be insignificant, if even noticeable.

The current source (not shown) is rated for 10 milliamps. It is also noted that the current levels supplied by the current source, depending on the desired brightness, can change as different rows are selected. To achieve a desired brightness, the current source is digitally programmable. As such, each individual O-LED pixel in a selected row is simultaneously driven by its respective current source with binary-weighted currents to obtain approximately equal brightness steps under digital control. The exemplary embodiment of the present invention is designed to operate with 16-brightness levels (i.e., 4 bits for the programmable current source) although, as one skilled in the art will appreciate, more brightness levels are contemplated (e.g., 32, 64, etc.). Additionally, in the exemplary embodiment of the present invention, it is assumed that the current source supplies current substantially independent of temperature.

The LED light emitting threshold typically exceeds 10 volts and current tends to increase non-linearly - but at the low and sub-microampere levels for continuous, flicker-free, light emission.

Although the invention is illustrated and described herein as embodied in a reference pixel coupled with the last pixel element of each column of an overall O-LED array, the invention is not intended to be limited to the details shown. Rather, various modifications may be made in the details within the scope and range of equivalents of the claims and without departing from the invention.

What is claimed:

1. A circuit, coupled to a current source, for driving a plurality of active organic light emitting diodes (O-LEDs) arranged in a column at a desired brightness comprising:

an input leg of a current mirror for establishing a reference current for driving an active O-LED;

a plurality of selecting means, responsive to a row select signal, for respectively selecting an O-LED from the plurality of active O-LEDs;

an output leg of a current mirror for supplying a mirror of the established reference current to the selected O-LED;

a plurality of charging means for respectively storing a voltage differential which is related to the established reference current in order to continuously drive the selected O-LED.

2. The circuit of claim 1, wherein the input leg of the current mirror includes a reference O-LED separate from any of the plurality of active O-LEDs.

3. The circuit of claim 2, wherein the reference O-LED substantially matches the active O-LED.

4. The circuit of claim 1, wherein the input leg of the current mirror includes a single reference O-LED separate from any of the plurality of active O-LEDs.

5. The circuit of claim 1, wherein the input leg of the current mirror includes a transistor coupled to the reference O-LED.

6. The circuit of claim 1, wherein each of the plurality of selecting means includes a transistor.

7. The circuit of claim 1, wherein each of the plurality of charging means includes a capacitor.

8. An array of organic light emitting diodes (O-LEDs), having improved driving circuitry comprising:

a plurality of rows and a plurality of columns of active O-LEDs;

an adjustable current source coupled to one of the plurality of columns for providing a reference current to the column of active O-LEDs, the reference current level being configured to produce a desired brightness level in a selected one of the O-LEDs in the column;

reference means, coupled to the one of the plurality of columns, for establishing the reference current level in a reference O-LED;

selecting means, responsive to a row select signal, for selecting the selected O-LED in the column;

converting means, responsive to the selecting means, for converting the established reference current in the reference O-LED into a corresponding voltage level and for storing the corresponding voltage level; and means, responsive to the stored voltage level for driving the selected O-LED with a current substantially equal to the reference current to produce the desired brightness level in the selected O-LED.

9. The circuit of claim 8, wherein the matrix of O-LEDs includes an active area on which images are displayed and the reference O-LED is in a portion of the column outside of the active area.

10. The circuit of claim 9, wherein the reference O-LED substantially matches the selected O-LED.

11. An array of organic light emitting diodes (O-LEDs), coupled to a digital current source, having improved driving circuitry comprising:

a plurality of rows and a plurality of columns of active O-LEDs;

reference means, coupled to each of the plurality of columns, for establishing a reference current for driving each active O-LED in every row of the respective column;

a plurality of selecting means, responsive to a row select signal, for respectively selecting an active O-LED;

a plurality of converting means, responsive to the selecting means, for converting the established reference current into a predetermined voltage;

a plurality of means, responsive to the means for converting, for allowing a respectively selected O-LED to be driven at the desired brightness, wherein the reference means includes a reference O-LED, wherein the reference means includes an input leg of a current mirror including the reference O-LED.

12. A method of driving a plurality of active organic light emitting diodes (O-LEDs) arranged in a column at a desired brightness, the method comprising the steps of:

driving the column with a reference current level configured to produce a desired brightness level in a selected one of the O-LEDs;

establishing the reference current level in a reference O-LED;

selecting one of the O-LEDs in the column;

converting the established reference current in the reference O-LED into a corresponding voltage level;

transmitting the voltage level to the selected O-LED;

storing the corresponding voltage level;

converting the stored voltage level into a current substantially equal to the reference current; and driving the selected O-LED with the current substantially equal to the reference current to produce the desired brightness level in the selected O-LED.

13. The method of claim 12, wherein the reference current is established by way of a reference O-LED which is separate from any of the O-LEDs in the column.

14. The method of claim 13, wherein the reference O-LED substantially matches the selected O-LED.

15. The method of claim 12, wherein the step of storing includes a step of storing the reference voltage on a capacitor associated with the selected O-LED.

* * * * *